United States Patent [19]

Platt

[11] Patent Number: 4,579,159

[45] Date of Patent: Apr. 1, 1986

[54] APPARATUS FOR PEELING SMALL LOGS

[75] Inventor: Sterling B. Platt, Stamford, Conn.

[73] Assignee: Champion International Corporation, Stamford, Conn.

[21] Appl. No.: 727,385

[22] Filed: Apr. 25, 1985

[51] Int. Cl.[4] ..... B27L 5/00

[52] U.S. Cl. ..... 144/209 R; 82/40 R; 142/53

[58] Field of Search ..... 82/40 R; 142/48, 53, 142/55, 57; 144/209 R

[56] References Cited

U.S. PATENT DOCUMENTS

| | | | |
|---|---|---|---|
| 3,252,488 | 5/1966 | Molyneuk | 144/209 R |
| 3,455,351 | 7/1969 | Hayes | 144/209 R |
| 3,506,045 | 4/1970 | Bosco | 144/209 R |
| 3,513,891 | 5/1970 | Heth | 144/209 R |
| 3,672,416 | 6/1972 | Reed | 144/209 R |
| 4,342,348 | 8/1982 | Lichterwalter | 82/40 R |
| 4,469,155 | 9/1984 | Platt | 144/209 R |

*Primary Examiner*—W. D. Bray

*Attorney, Agent, or Firm*—Evelyn M. Sommer; William W. Jones

[57] ABSTRACT

The apparatus allows logs to be peeled to smaller cores so as to increase veneer recovery, especially in operations where logs of ten inches or smaller prevail. The apparatus includes concentric dogs which embed in the ends of logs during peeling. The outer dog is retractable and the inner dog has a reduced shank portion which projects from an enlarged basal portion. The outer dog has a reduced diameter bore which supportingly engages the shank of the inner dog to give added strength and allow ultimate reduction in the diameter of the inner dog shank.

11 Claims, 4 Drawing Figures

APPARATUS FOR PEELING SMALL LOGS

This invention relates to an improved dog set for use in veneer peeling lathes and to lathes incorporating such improved dog sets. This invention is an improvement of the subject matter disclosed and claimed in my U.S. Pat. No. 4,469,155, issued Sept. 4, 1984.

The subject matter of my above-noted U.S. patent is a dog for a veneer lathe, which is detachably secured to an inner spindle on a two-spindle lathe. The dog has an enlarged basal portion approximately the same diameter as the inner spindle and a reduced stem portion which terminates in the teeth which imbed in the logs during the peeling operation. The reduced stem extends through the bore of the outer spindle dog. When peeling of the log begins, the inner and outer spindle dogs are both embedded in the ends of the log. When the peeling has progressed to a point approaching the outer surface of the outer dog, the outer spindle retracts, pulling the outer spindle dog free from the ends of the log and back out of the path of the peeling knives. The inner spindle dog remains embedded in the log whereupon peeling continues until the diameter of the remaining core is slightly larger than the diameter of the dog stem. Using this approach, logs can be peeled down to a three-inch diameter core, whereas dogs not having the reduced stem portions, as in the prior art, allow peeling only to about a five-inch diameter core.

This invention relates to an improvement to the subject matter disclosed in my U.S. Pat. No. 4,469,155 whereby logs can be peeled to a two and one-half inch core. The dogs of this invention can operate with an inner dog which has a reduced stem of about two and one-quarter inches in diameter. The outer dog is also provided with a reduced outside diameter which is preferably about four and three-eighths inches, and the bore of the outer dog is reduced and provided with a bushing in which the inner dog stem telescopes. In this manner, the log can be peeled to a smaller diameter before the outer dog must be retracted, thereby lowering the stress imparted to the inner dog once the outer dog is retracted. Additionally, the close interfit between the inner dog shank and the outer dog bore reinforces the inner dog and allows the use of a smaller diameter inner dog shank without increasing the liklihood of twisting or otherwise damaging the inner dog during the peeling operation.

It is, therefore, an object of this invention to provide an improved apparatus for use in the peeling of logs to make veneer.

It is an additional object of this invention to provide an apparatus of the character described wherein concentric dogs are used to engage ends of the log being peeled, and the inner dog has a reduced shank portion to allow peeling to a smaller diameter core.

It is another object of this invention to provide an apparatus of the character described wherein the bore of the outer dog is reduced in diameter so as to snugly engage the shank of the inner dog to provide increased support and strength to the inner dog despite the reduced shank diameter of the inner dog.

These and other objects and advantages of the invention will become more readily apparent from the following detailed description of a preferred embodiment thereof when taken in conjunction with the accompanying drawings, in which.

Figure 1:
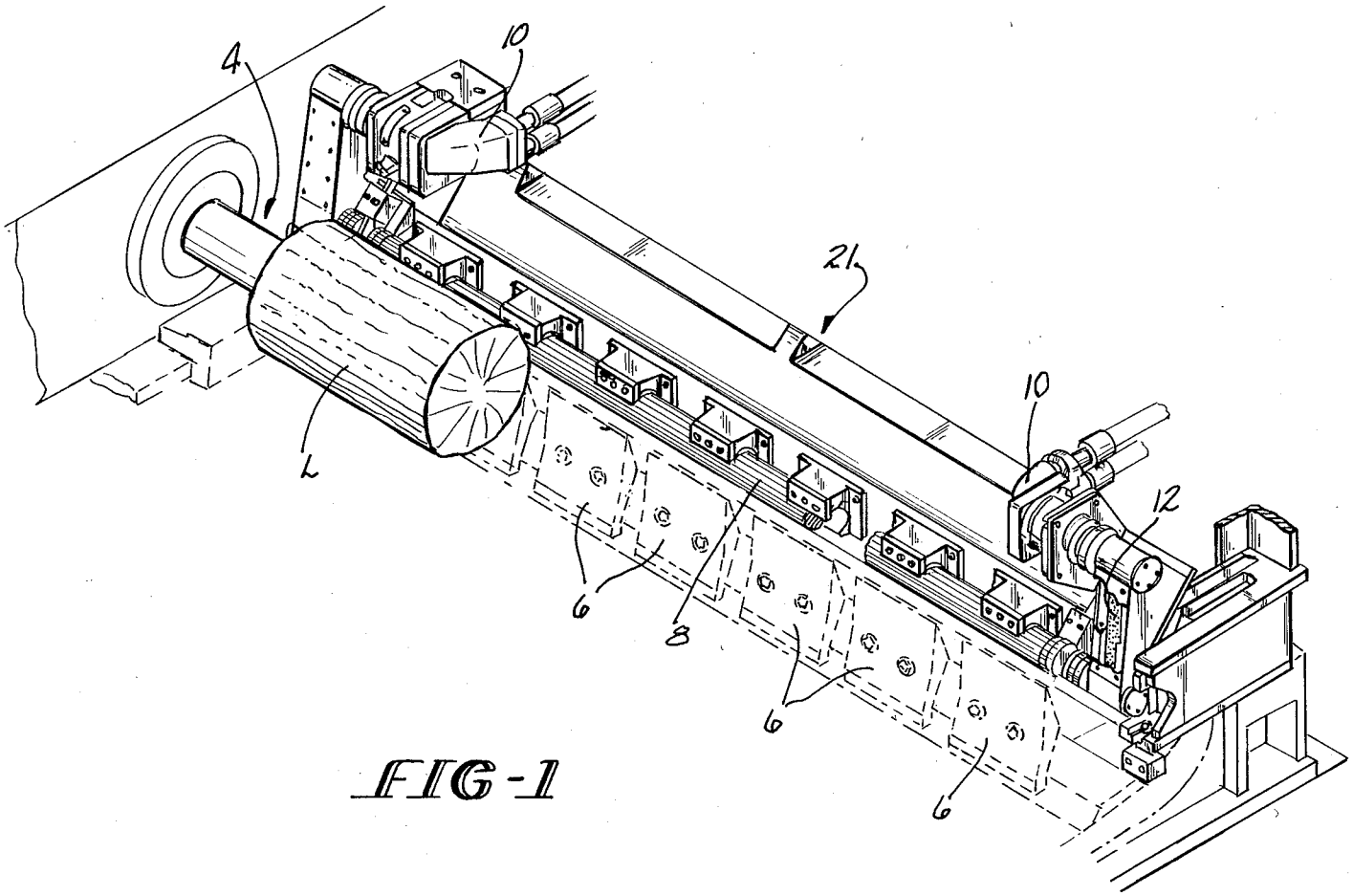
FIG. 1 is a fragmented perspective view of a lathe preferred for use with the apparatus of this invention.

Referring to the drawings, there is shown in FIG. 1 a lathe of the type used to peel logs to make veneer. The lathe, denoted generally by the numeral 2 has a pair of spindle sets denoted generally by the numeral 4 which support opposite ends of a log L being peeled. A plurality of knives 6 are mounted on the lathe and the log L is rotated in the lathe by one or more power driven roller bars 8 which engage the exterior of the log L. Motors 10 operate chain drives 12 connected to ends of the roller bars 8. The general lathe shown in FIGS. 1 and 2 is manufactured by Coe Manufacturing Company.

Figure 2:
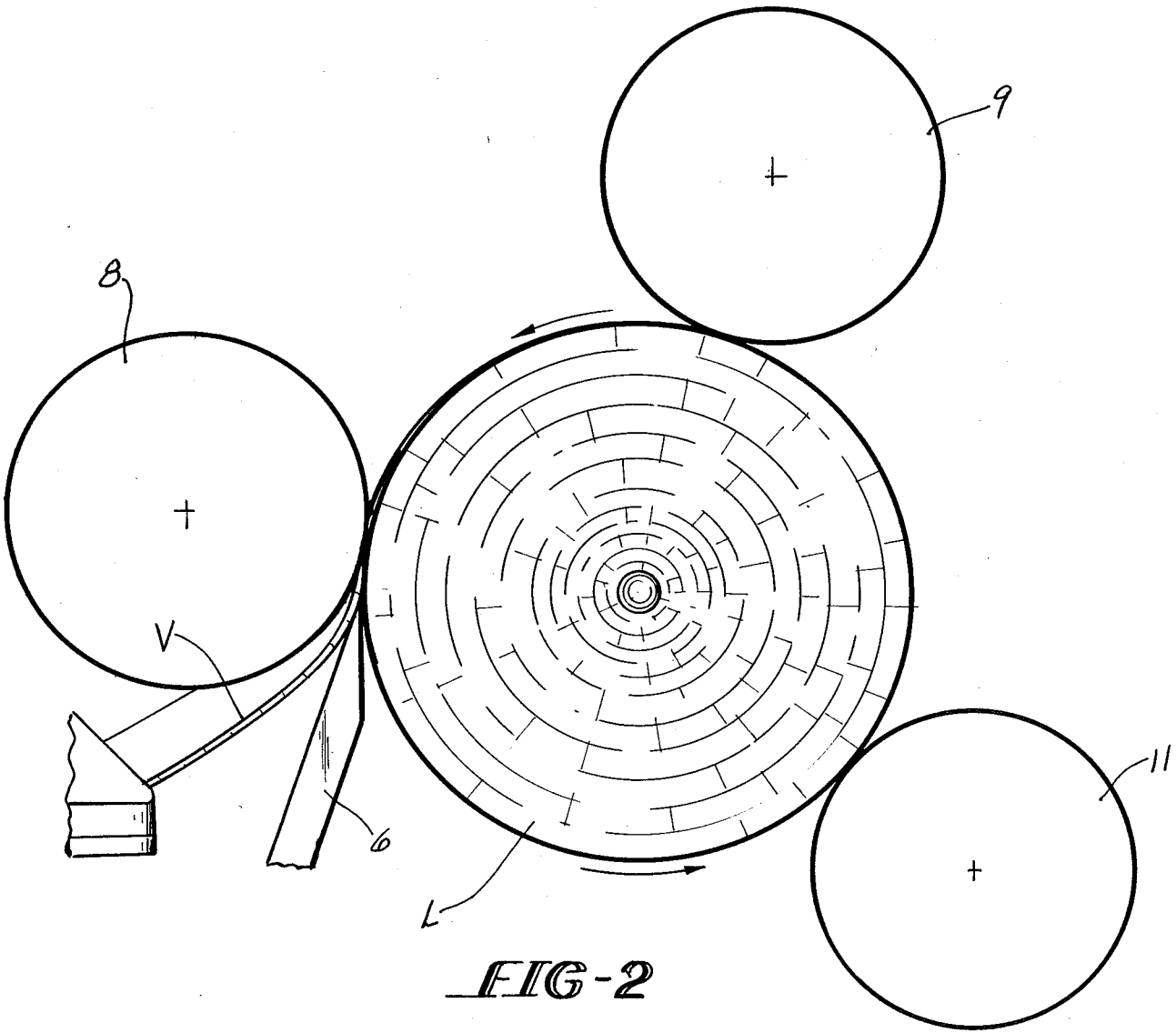
FIG. 2 is a schematic sectional view of the log being peeled, the peeling knife, and the rolls driving and supporting the log as it rotates during the peeling operation.

Referring to FIG. 2, the orientation of the log L, roller bars 8, 9 and 11 and knives 6 is shown. The roller bars 8 and 9 are power driven and rotate the log L in the counterclockwise direction, as viewed in FIG. 2, into the knives 6. The peeled veneer V passes over the knives 6 to a collection station on the lathe. The roller 11 is an idler roller which supports and guides the log L as it is fed onto the knives 6. This type of power rotating of the logs with two rollers while adding a third idler roller is relatively new in the log peeling lathe art and greatly speeds up the peeling operation. Attempts have been made to use these new lathes in a centerless mode by withdrawing the dogs completely from the ends of the logs after peeling of a certain percentage of the log has been accomplished. This would allow peeling to a smaller diameter core. These attempts have not proven successful since the three rollers do not provide sufficient control of the log to prevent it from vibrating after the dogs are removed.

Figure 3:
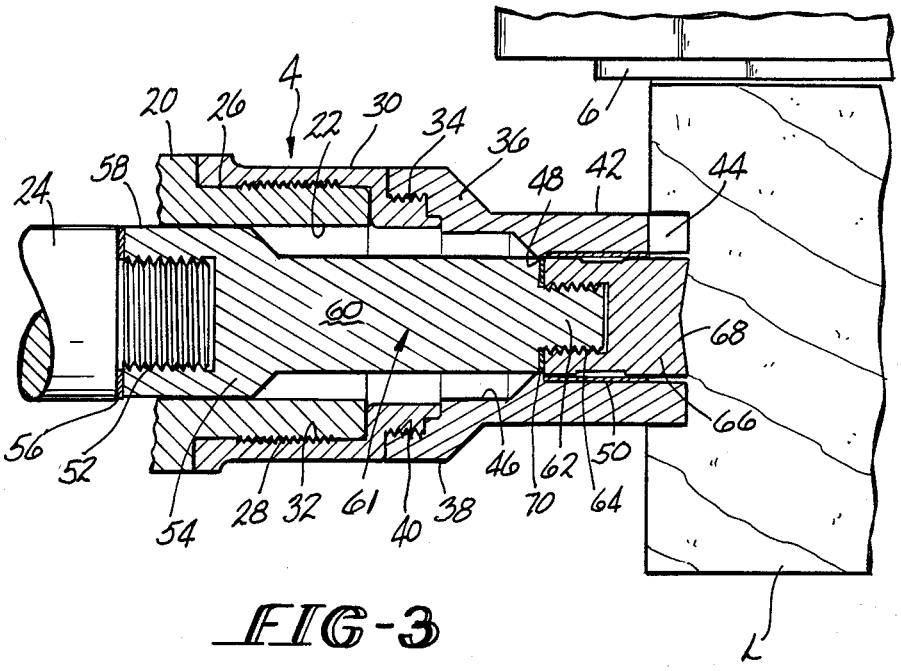
FIG. 3 is a fragmented sectional view of one end of a log mounted in the lathe showing the inner and outer dogs concurrently embedded in the log during an early stage in the peeling.
Figure 4:
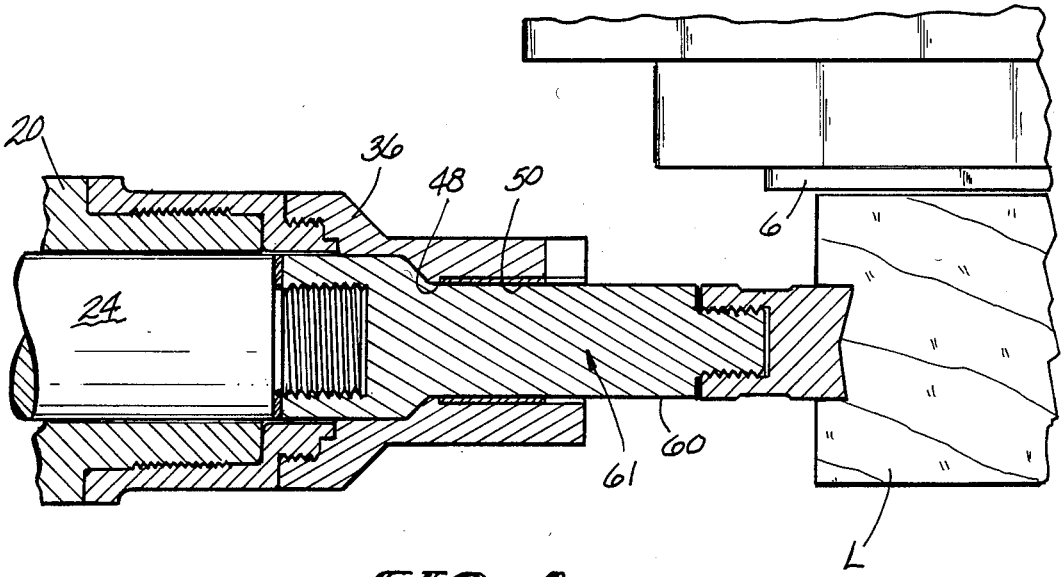
FIG. 4 is a sectional view similar to FIG. 3 but showing the outer dog retracted while the inner dog remains embedded in the log during a later stage in the peeling of the log.

FIGS. 3 and 4 show details of the dogs on the lathe spindle sets 4. The spindles include an outer spindle 20 having a bore 22 in which an inner spindle 24 is telescopingly received The end of the outer spindle 20 is necked down at 26 and externally threaded at 28. An adaptor collar 30 having an internally threaded bore 32 is screwed onto the spindle 20, the collar 30 having an externally threaded boss 34 which projects axially therefrom. The outer dog 36 has an enlarged basal portion 38 with an internally threaded counter bore 40 which is threaded onto the collar boss 34. The outer dog 36 has an externally reduced diameter stem 42 which projects axially from the basal portion 38 and terminates in a plurality of teeth 44 which are embedded in the end of the log L. The outer dog 36 has an intermediate counter bore 46 which is approximately the same diameter as the inner spindle 24 and which opens into a through bore 48. The through bore 48 is fitted with a bushing 50. The inner spindle 24 has an externally threaded boss 52 onto which is screwed a dog adapter 54. A thrust washer 56 is sandwiched between the adapter 54 and the inner spindle 24. The adapter 54 has an enlarged basal portion 58, which is snugly telescopingly received in the bore 22 of the outer spindle 20, and a reduced stem portion 60, which is snugly telescopingly received in the bore 48 and bushing 50 of the outer dog 36. The adapter 54 includes a boss 62 having external threads 64 onto which is threaded a nose member 66. The nose member 66 has a toothed outer end 68 which is embedded into the end of the log L. It will be noted that the adapter 54 and the nose member 66 comprise the inner dog 61 and that the outside diameter of the stem portion 60 of the adapter 54 and the outside diameter of the nose member 66 provide a snug telescopingly supported engagement with the bore 48 and bushing 50 in the outer dog 36. A thrust washer 70 is sandwiched between the nose member 66 and adapter 54 to provide a secure connection between the two. The bore 48 supports the inner dog stem 60 and nose 66 so as to enable the stem and nose of the inner dog to be two and one-quarter inches in diameter, thus allowing peeling to a comparable diameter core.

IN FIG. 3, both dogs are embedded in the ends of the log L and the knives 6 are used to peel the log. The reduced diameter portion 42 of the outer dog 36 allows the knives 6 to move closer to the center of the log L before the outer dog 36 must be retracted. This permits peeling to a smaller diameter block, thus lowering the stress put on the inner dog and spindle 24 after the outer dog 36 and spindle 20 are retracted.

FIG. 4 shows the condition of the lathe when the outer spindle 20 and dog 36 have been retracted leaving only the inner dog 61 supporting the ends of the log L. It will be noted that the outer dog stem 42 projects beyond the inner dog basal portion 58 so that the bore 48 and bushing 50 support the stem 60 of the inner dog 61 beyond the basal portion 58. The outer dog 36 and collar 30 are internally configured in such a way as to give full support to the basal part of the inner dog 61 when the outer dog 36 is retracted, as shown in FIG. 4. As noted previously, this allows the stem 60 of the inner dog 61 to be made with the smallest possible diameter. After retraction of the outer dog 36, peeling of the log L continues until the knives 6 are about one-quarter inch from the inner dog 61, at which time, the core is dropped out of the lathe by retracting the inner dogs 61.

It will be readily appreciated that this invention allows the inner dogs of a two-dog set on a log peeling lathe to be made even smaller so that a maximum amount of veneer can be obtained from the log. This invention provides an economically sound approach to the problem of peeling small logs to make veneer. Mills using this invention can be established where the available timber consists primarily of smaller trees which were heretofore not economical for making veneer.

Since many changes and variations of the disclosed embodiment of the invention may be made without departing from the inventive concept, it is not intended to limit the invention otherwise than as required by the appended claims.

What is claimed is:

1. A dog for use on an outer spindle of a multi-spindle veneer lathe, said dog comprising:

(a) a basal portion having threaded means at one end for releasably securing the dog to the outer spindle;

(b) an axial passage extending through said dog, said axial passage having an enlarged diameter base part adjacent to said threaded means, and a reduced diameter remaining part extending from said enlarged diameter base part to the end of said dog opposite said basal portion; and (c) said enlarged diameter base part of said axial passage being sized to telescopingly engage and support an enlarged diameter basal portion of an inner dog, and said reduced diameter remaining part of said axial passage being sized to telescopingly engage and support a reduced diameter stem portion of the inner dog.

2. The dog of claim 1 further comprising a bushing mounted in said reduced diameter remaining part of said axial passage for engaging the stem part of the inner dog.

3. The dog of claim 1 further comprising a plurality of teeth at said end of said dog opposite said basal portion for embedment in the end of a log mounted in the lathe.

4. The dog of claim 1 further comprising a reduced diameter stem outside portion adjacent said basal portion, whereby said basal portion has a larger outside diameter than said stem portion.

5. A dog for use on an outer spindle of a multi-spindle veneer lathe, said dog comprising:

(a) an outer side surface having an enlarged diameter basal portion at one end of said dog and a reduced diameter stem portion adjacent to said basal portion and extending to the opposite end of said dog;

(b) an axial passage extending through said dog, said axial passage having an enlarged diameter base part having a threaded counter bore for releasable securement of said dog to the outer spindle of the lathe, and said axial passage further having a reduced diameter remaining part extending from an inner end of said enlarged diameter base part to said opposite end of said dog; and (c) said enlarged diameter base part of said axial passage being sized to telescopingly engage and support an enlarged diameter basal portion of an inner dog, and said reduced diameter remaining part of said axial passage being sized to telescopingly engage and support a reduced diameter stem portion of the inner dog.

6. The dog of claim 1 further comprising a plurality of teeth at said opposite end of said dog for embedment in a log mounted in the lathe.

7. In a veneer lathe, an apparatus for supporting ends of logs during peeling, said apparatus comprising:

(a) an outer spindle having a bore, said outer spindle being rotatable on the lathe;

(b) an inner spindle mounted in said bore of said outer spindle, said inner spindle being rotatable on the lathe;

(c) said outer spindle being reciprocally axially slidably movable over said inner spindle;

(d) an inner dog removably mounted on an end of said inner spindle, said inner dog having a basal portion which is substantially the same diameter as said inner spindle, and an elongated stem portion which has a substantially smaller diameter than said basal portion, and said inner dog having teeth on an end of said stem portion for embedment in the end of the log; and (e) an outer dog removably mounted on an end of said outer spindle, said outer dog having a through passage with a base part having a diameter approximately equal to the diameter of said basal portion of said inner dog so as to engage and support said inner dog basal portion when said outer dog is in a retracted position, and said through passage having a remaining part having a diameter approximately equal to the diameter of said inner dog stem portion so as to engage and support said inner dog stem portion when said outer dog is in said retracted position.

8. The veneer lathe of claim 7 further comprising a bushing mounted in said remaining part of said outer dog through passage to slidingly house said inner dog stem portion.

9. The veneer lathe of claim 7, wherein said outer dog has an outer surface with a basal portion having an enlarged diameter and with a reduced diameter stem portion projecting toward the end of the log.

10. The veneer lathe of claim 9, wherein said outer dog stem portion has a diameter of about four and three-eighths inches and said inner dog stem portion has a diameter of about two and one-quarter inches.

11. In a veneer lathe, an apparatus for supporting ends of logs during peeling, said apparatus comprising:

(a) an outer spindle having a bore, said outer spindle being rotatable on the lathe;

(b) an inner spindle mounted in said bore of said outer spindle, said inner spindle being rotatable on the lathe;

(c) said outer spindle being reciprocally axially slidably movable over said inner spindle;

(d) an inner dog removably mounted on an end of said inner spindle, said inner dog having an elongated stem portion which has a substantially smaller diameter than said inner spindle, and said inner dog having teeth on an end of said stem portion for embedment in the end of the log; and (e) an outer dog removably mounted on an end of said outer spindle, said outer dog having a through passsage with a part having a diameter approximately equal to the diameter of said inner dog stem portion so as to engage and support said inner dog stem portion when said outer dog is in a retracted position.

* * * * *